United States Patent [19]

Nuesslein et al.

[11] Patent Number: 4,851,140

[45] Date of Patent: Jul. 25, 1989

[54] AQUEOUS LIQUID FABRIC TREATMENT PREPARATION

[75] Inventors: Hans Nuesslein, Langenfeld; Rolf Puchta, Haan; Theodor Voelkel, Duesseldorf; Eric Sung, Monheim, all of Fed. Rep. of Germany

[73] Assignee: Henkel Kommanditgesellschaft auf Aktien, Duesseldorf, Fed. Rep. of Germany

[21] Appl. No.: 160,873

[22] Filed: Feb. 26, 1988

[30] Foreign Application Priority Data

Feb. 28, 1987 [DE] Fed. Rep. of Germany ..... 3706664

[51] Int. Cl.[4] ..... D06M 13/02; D06M 13/18; D06M 13/20; D06M 13/38

[52] U.S. Cl. ..... 252/8.8; 252/8.6; 252/8.9; 252/153; 252/548; 427/389.9; 427/393.1

[58] Field of Search ..... 252/8.8, 8.6, 548, DIG. 14, 252/153; 427/389.9, 393.1

[56] References Cited

U.S. PATENT DOCUMENTS

| | | | |
|---|---|---|---|
| 3,775,316 | 11/1973 | Berg et al. | 252/8.8 |
| 4,000,340 | 12/1976 | Murphy et al. | 428/35 |
| 4,464,273 | 8/1984 | Parslow | 252/8.8 |
| 4,476,030 | 10/1984 | May | 252/8.8 |
| 4,623,471 | 11/1986 | Wilsberg | 252/8.8 |

*Primary Examiner*—Dennis Albrecht
*Assistant Examiner*—Kathlene Markowski
*Attorney, Agent, or Firm*—Ernest G. Szoke; Wayne C. Jaeschke; Real J. Grandmaison

[57] ABSTRACT

A liquid fabric treatment composition comprising aliphatic hydrocarbon, fatty acid, fatty acid salt, fatty acid ester, and a fatty acid condensate of a natural fat and hydroxyalkyl polyamine in aqueous medium. The composition provides washed fabrics treated therewith with softness and smoothness which, particularly, makes large articles of washing easier to iron by hand ironing or by rotary ironing.

14 Claims, No Drawings

AQUEOUS LIQUID FABRIC TREATMENT PREPARATION

BACKGROUND OF THE INVENTION

1. Field of the Invention

This invention relates to a liquid preparation suitable for the treatment of washed fabrics which transfers to the fabrics from an aqueous solution and provides them with softness and smoothness.

Washed fabrics are often treated with certain agents which provide the fabrics with desired properties, for example softness, anti-static properties, microbicidal properties, flame-retarding properties, water-repellent properties, absorbency, smoothness, and fragrance. Preparations containing suitable active substances may act on the fabrics either during or after washing, for example during rinsing or in the dryer. Preparations containing active substances which are either soluble or dispersible in the aqueous medium are suitable for application to fabrics in aqueous liquors. Active substances that are completely or substantially insoluble or non-dispersible in water are frequently applied in dryers where the active substances soften at the high temperatures in the dryer and are mechanically transferred in this state to the fabrics which come into contact with them. Certain fabric treatment preparations contain combinations of active substances so that the fabrics treated with them are given many of the desired properties at one and the same time.

2. Discussion of Related Art

U.S. Pat. No. 3,775,316, for example, describes final-rinse preparations for washed fabrics which contain both fabricsoftening and antimicrobial substances, the fabric-softening component being a combination of a fatty acid/hydroxyalkyl polyamine condensate and a quaternary ammonium compound, while the antimicrobial agent is also a quaternary ammonium compound, but one that is different from the fabric-softening quaternary ammonium compound. Another example of a fabric treatment preparation is described in U.S. Pat. No. 4,000,340. This preparation, which is intended for use in an automatic dryer, contains a combination of active substances which both softens and freshens the treated fabrics. The fabric-freshening component of this known preparation consists of alcohols, carboxylic acids, carboxylic acid salts, optionally paraffin, an ester component or mixture of such compounds. In addition, the preparation may contain fragrances, antistatic agents, disinfectants, bactericides, fungicides and flame-retarding agents.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to provide a liquid fabric treatment preparation intended for use in aqueous liquors which not only freshens and softens the treated fabrics, but also provides them with surface smoothness which, above all, makes large items of laundry easier to iron such as by hand ironing or rotary machine ironing either in the home or in institutional laundries. According to the invention, this object is achieved by the provision of a liquid composition suitable for the treatment of washed fabrics in aqueous liquor and which is based on aliphatic and cycloaliphatic hydrocarbons, fatty acid esters, fatty acids, fatty acid salts, nonionic dispersants or mixtures of these active substances and which, in addition, contains a fatty acid condensate of a natural fat and a hydroxyalkyl polyamine, and water as a carrier for the substances mentioned. The condensate of a natural fat and hydroxyalkyl polyamine is described in German Pat. No. 19 22 047. It is prepared by reaction of a triglyceride of $C_8$–$C_{24}$ fatty acids, wherein at least 50% by weight of the fatty acids contain 16 or more carbon atoms, with a hydroxyalkyl polyamine containing at least one hydroxyethyl, hydroxypropyl or dihydroxypropyl group and at least two hydrogen atoms attached to nitrogen. For each primary and secondary amino group and each hydroxyl group present in the hydroxyalkyl polyamine, ⅓ mole of the fatty acid triglyceride is used to 1 mole of the hydroxyalkyl polyamine in the reaction. In accordance with this invention, by virtue of the presence of the afore-mentioned condensate, the combination of active substances may be made up into an extremely stable aquous dispersion which, in addition, has the advantage when applied in aqueous liquor that the other constituents of the composition which are not readily absorbed onto textiles from aqueous liquor may be transferred to the fabrics in high concentration together with the fatty acid condensate, so that the quantity of unuseable active substances is extremely small where the composition according to the invention is used as directed. The composition according to the invention is best applied in the final rinse of an automatic wash program. The rinsing water used for the final rinse generally has the temperature of unheated tapwater, i.e. the temperature of the rinsing water is in the range from about 10° to 15° C. Accordingly, it is particularly important that the composition according to the invention can dissolve quickly, completely and uniformly in water having such a low temperature. Such is the case with the combination of active substances according to this invention.

In one particular embodiment of the composition according to the invention, the ratio by weight of fatty acid condensate to fatty acid ester is in the range of from 1:50 to 10:1. The content of fatty acid condensate in the composition according to the invention is preferably in the range of from 0.5 to 15% by weight, and more preferably in the range of 2 to 10% by weight, based on the weight of the composition. Another feature of the fabric treatment composition according to the invention is the ratio by weight of the fatty acid condensate to the hydrocarbon mixture used. It is in the range of from 1:15 to 3:1. Suitable hydrocarbons include, in particular, linear or branched $C_8$–$C_{40}$ paraffin hydrocarbons or mixtures of different hydrocarbons. An important factor in the selection of suitable hydrocarbons is that they should have a liquid to at most wax-like consistency at room temperature.

Compositions according to the invention having a particularly balanced combination of properties contain the fatty acid condensate, the hydrocarbons and fatty acid esters in a quantity of from about 2 to about 20% by weight, based on the weight of the composition as a whole.

The liquid compositions according to the invention essentially contain water as a carrier for the active substances. In addition, the compositions according to the invention may contain small amounts of lower alcohols or glycols, for example ethanol, isopropyl alcohol, and ethylene glycol. The water content of the compositions is in the range of from 50 to 95% by weight, preferred compositions according to the invention having a water content of from 70 to 85% by weight, based on the weight of the compositions.

The compositions according to the invention contain as nonionic dispersants adducts of from 2 to 40 moles of ethylene oxide and/or propylene oxide, but preferably ethylene oxide, with 1 mole of $C_{12}$–$C_{22}$ fatty alcohol together with the dispersing fatty acid condensate. The fatty alcohols may be both saturated and unsaturated, may contain a linear or branched carbon chain and may be a mixture of fatty alcohols of different chain length which, in addition, may be condensed with different quantities of ethylene oxide and/or propylene oxide. The adducts are present in quantities of from 1.5 to 20% by weight, based on the weight of the composition. In one particular embodiment of the composition according to the invention, the ratio by weight of fatty acid condensate to dispersant is in the range of from 5:1 to 1:10. Particularly suitable dispersants for the compositions according to the invention include adducts of from 15 to 20 moles of ethylene oxide with 1 mole of $C_{16}$–$C_{18}$ fatty alcohol.

Other suitable dispersants include those obtained by the addition of ethylene oxide and/or propylene oxide to fatty acids, fatty amines, fatty acid of sulfonic acid amides, polyethylene or polypropylene glycols, epoxy glycols, alkylenediamine or aliphatic $C_1$–$C_8$, preferably $C_3$–$C_6$, alcohols. 1,4-alkyl glycosides and 2,2-alkyl glycosides containing $C_{10}$–$C_{20}$ alkyl radicals are also suitable additives.

The composition of typical preparations according to the invention lies within the following ranges:

(a) from 2 to 15% by weight of fatty acid condensate,
(b) from 0.1 to 10% by weight of aliphatic hydrocarbons,
(c) from 0.5 to 10% by weight of fatty acid esters,
(d) from 0.1 to 5% by weight of fatty acids and fatty acid salts,
(e) from 2 to 20% by weight of nonionic dispersants,
(f) from 50 to 80% by weight of water, and
(g) optionally, dyes, perfumes, preservatives, lower alcohols, viscosity regulators and other optional auxiliaries typically present in aqueous fabric aftertreatment preparations.

Suitable viscosity regulators include inorganic or organic salts, such as for example, sodium chloride and magnesium chloride. Other auxiliaries typically present in fabric treatment preparations include, for example, acids, such as phosphoric acid or glycolic acid, bleaches, such as $H_2O_2$, foam inhibitors such as silicone oils, and optical brighteners.

In the application of the compositions according to the invention for the treatment of washed fabrics during rinsing in aqueous liquor, the active substances function particularly extensively by transfer to the washed fabric articles to be treated. An important factor in the extensive utilization and transfer of the active substances may be attributed to the presence of the fatty acid condensate in the composition according to the invention. The fatty acid condensate is presumably transferred from the aqueous liquor to the surface of the washed articles to be treated, taking with it a substantial amount of the other active substances, which is observed to a distinctly lesser extent in the absence of the fatty acid condensate. Accordingly, the present invention also relates to the use of the compositions according to the invention for the treatment of washed fabrics during their rinsing in aqueous liquor.

The compositions according to the invention may be prepared by dispersing the active substances and auxiliaries in the liquid carrier, primarily water, best under the effect of intense shear forces. Another method of preparing the compositions according to the invention is to prepare a melt of the solid to wax-like constituents, optionally with the addition of part of the liquid constituents of the composition according to the invention, and introducing the melt into the remaining part of the liquid constituents, optionally under the effect of intense shear forces. The dispersions obtained are highly stable in storage, which again is mainly attributable to the presence according to the invention of the fatty acid condensate in the dispersion. However, not only are the dispersions thus prepared stable in storage, the dispersions prepared by dilution with water to the in-use concentration are also stable. The in-use concentration is in the range of from 0.1 to 10 g of the composition per liter of treatment liquor, depending on whether the preparation is used institutionally or in the home. Fabrics treated therewith not only have a pleasant feel after drying, they are also easier to iron by hand ironing or by rotary ironing.

EXAMPLE I

A homogeneous melt was prepared from 100 g of an adduct of 20 moles of ethylene oxide with $C_{18}$–$C_{20}$ fatty alcohol ("Eumulgin B2®", Henkel Corp.), 50 g of a fatty acid condensate prepared by reaction of hardened beef tallow in which 70% by weight of the fatty acid is $C_{18}$ fatty acid with hydroxyethyl ethanolamine, 30 g of hardened beef tallow in which 70% by weight of the fatty acid is $C_{18}$ fatty acid,, 10 g of an ester mixture of mono- and di-$C_{16}C_{18}$-fatty acid glycerides, 10 g of technical grade stearic acid and 50 g of paraffin 60/62 by heating to approximately 70° C. The melt thus prepared was mixed with 750 g of water at room temperature with intensive stirring to form a uniform dispersion which possessed high stability in storage.

Freshly washed fabrics of cotton, wool, polyester and polyester/cotton (50:50) were treated for 3 minutes at about 20° C. with an aqueous liquor containing 30 g of the above dispersion and then dried.

By comparison with freshly washed, untreated fabrics of the same materials, the fabrics treated in accordance with the invention were judged to be distinctly softer than the untreated fabrics by five people experienced in the evaluation of fabric softness.

Mangle-moist cotton sheets treated in accordance with the invention were subjected to rotary ironing. After treated sheets had been thus ironed for 3 days, the rollers of the rotary ironing press did not have to be treated with wax, in contrast to the rotary ironing of sheets which had not been treated in accordance with the invention where the rollers had to be treated with wax twice daily. In hand ironing, distinctly less force had to be applied in the ironing of treated fabrics than in the ironing of untreated fabrics or fabrics which had not been treated in accordance with the invention.

EXAMPLE II

As described in Example I, a product according to the invention was prepared from the following constituents: 100 g of an adduct of 20 moles of ethylene oxide with $C_{18}$–$C_{20}$ fatty alcohol, 40 g of the fatty acid condensate described in Example I, 1.5 g of hardened beef tallow, 15 g of an ester mixture of mono- and di-$C_{16}$–$C_{18}$-fatty acid glyceride, 10 g of carnauba wax, and 5 g of a liquid paraffin oil of $C_8$–$C_{20}$ paraffin were melted and dispersed in 820 g of water. The product thus prepared was used in the same way as described in Example I and produced comparable results.

EXAMPLE III

Similar results were obtained with a product of the type described in Example II which additionally contained 2% by weight of soap, based on the total weight of the product according to the invention. The same applies to products containing up to 2% by weight of phosphoric acid or citric acid.

If instead of the mixture of fatty acid glycerides used in the composition of Example II, is used beeswax, carnauba wax, or china wax in the same or in different quantity as the fatty acid ester, a composition in accordance with this invention having superior fabric treatment properties was obtained.

We claim:

1. A liquid composition for treating washed fabrics in aqueous liquor and impart softness and smoothness to said fabrics, said composition consisting essentially of;

(a) from about 0.1 to about 10% by weight of an aliphatic hydrocarbon, (b) from about 0.1 to about 5% by weight of a fatty acid and/or a fatty acid salt, (c) from about 0.5 to about 10% by weight of a fatty acid ester, (d) from about 2 to about 20% by weight of a nonionic dispersant, (e) from about 2 to about 15% by weight of a fatty acid condensate of a natural fat and a hydroxyalkyl polyamine, and (f) from about 50 to about 80% by weight of water, based on the weight of said composition.

2. A liquid composition as in claim 1 wherein said fatty acid condensate comprises the reaction product of a triglyceride of a $C_8$–$C_{24}$ fatty acid wherein at least about 50% by weight of said fatty acid contains 16 or more carbon atoms, with a hydroxyalkyl polyamine containing at least one hydroxyethyl, hydroxypropyl or dihydroxypropyl group and at least two hydrogen atoms attached to nitrogen.

3. A liquid composition as in claim 1 wherein the ratio by weight of said fatty acid condensate to said fatty acid ester is in the range of from about 1:50 to 10:1.

4. A liquid composition as in claim 1 wherein the ratio by weight of said fatty acid condensate to said hydrocarbon is in the range of from about 1:15 to 3:1.

5. A liquid composition as in claim 1 wherein said hydrocarbon comprises a linear or branched $C_8$–$C_{40}$ paraffin hydrocarbon.

6. A liquid composition as in claim 1 wherein said fatty acid condensate, hydrocarbon and fatty acid ester are present in a quantity of from about 2 to about 20% by weight, based on the weight of said composition.

7. A liquid composition as in claim 1 wherein said nonionic dispersant comprises an adduct of from about 2 to about 40 moles of ethylene oxide or propylene oxide with 1 mole of a $C_{12}$–$C_{22}$ fatty alcohol.

8. A process of treating washed fabrics in aqueous liquor and imparting softness and smoothness to said fabrics, comprising rinsing said fabrics with a composition consisting essentially of;

(a) from about 0.1 to about 10% by weight of an aliphatic hydrocarbon, (b) from about 0.1 to about 5% by weight of a fatty acid and/or a fatty acid salt, (c) from about 0.5 to about 10% by weight of a fatty acid ester, (d) from about 2 to about 20% by weight of a nonionic dispersant, (e) from about 2 to about 15% by weight of a fatty acid condensate of a natural fat and a hydroxyalkyl polyamine, and (f) from about 50 to about 80% by weight of water, based on the weight of said composition.

9. A process as in claim 8 wherein said fatty acid condensate comprises the reaction product of a triglyceride of a $C_8$–$C_{24}$ fatty acid wherein at least about 50% by weight of said fatty acid contains 16 or more carbon atoms, with a hydroxyalkyl polyamine containing at least one hydroxyethyl, hydroxypropyl or dihydroxypropyl group and at least two hydrogen atoms attached to nitrogen.

10. A process as in claim 8 wherein the ratio by weight of said fatty acid condensate to said fatty acid ester is in the range of from about 1:50 to 10:1.

11. A process as in claim 8 wherein the ratio by weight of said fatty acid condensate to said hydrocarbon is in the range of from about 1:15 to 3:1.

12. A process as in claim 8 wherein said hydrocarbon comprises a linear or branched $C_8$–$C_{40}$ paraffin hydrocarbon.

13. A process as in claim 8 wherein said fatty acid condensate, hydrocarbon and fatty acid ester are present in a quantity of from about 2 to about 20% by weight, based on the weight of said composition.

14. A process as in claim 8 wherein said nonionic dispersant comprises an adduct of from about 2 to about 40 moles of ethylene oxide or propylene oxide with 1 mole of a $C_{12}$–$C_{22}$ fatty alcohol, and is present in an amount of from about 1.5 to about 20% by weight, based on the weight of said composition.

* * * * *